US011247794B2

(12) United States Patent
Wallenius et al.

(10) Patent No.: US 11,247,794 B2
(45) Date of Patent: Feb. 15, 2022

(54) METHOD OF COMPRESSING TISSUE BUNDLES

(71) Applicant: Essity Hygiene and Health Aktiebolag, Gothenburg (SE)

(72) Inventors: Hans Wallenius, Gothenburg (SE); Björn Larsson, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 124 days.

(21) Appl. No.: 16/469,052

(22) PCT Filed: Dec. 20, 2016

(86) PCT No.: PCT/EP2016/082012

§ 371 (c)(1),
(2) Date: Jun. 12, 2019

(87) PCT Pub. No.: WO2018/113936

PCT Pub. Date: Jun. 28, 2018

(65) Prior Publication Data

US 2020/0002036 A1 Jan. 2, 2020

(51) Int. Cl.
*B65B 25/14* (2006.01)
*B65B 63/02* (2006.01)
(Continued)

(52) U.S. Cl.
CPC ..... *B65B 25/14* (2013.01); *B65B 11/10* (2013.01); *B65B 63/026* (2013.01); *B65B 13/20* (2013.01)

(58) Field of Classification Search
CPC ..... B65B 25/14; B65B 11/10; B65B 63/026; B65B 13/20
(Continued)

(56) References Cited

U.S. PATENT DOCUMENTS 3,172,563 A * 3/1965 Harwood ..... B65D 83/08 221/48
4,623,074 A * 11/1986 Dearwester ..... A47K 10/421 206/494
(Continued)

FOREIGN PATENT DOCUMENTS

CN 101291859 A 10/2008
CN 101410045 A 4/2009
(Continued)

OTHER PUBLICATIONS

Office Action (Notification of the First Office Action) dated Jul. 31, 2020, by the China National Intellectual Property Administration (CNIPA) of the People's Republic of China in corresponding Chinese Patent Application No. 201680091498.4 and an English Translation of the Office Action. (14 pages).
(Continued)

*Primary Examiner* — Thanh K Truong
*Assistant Examiner* — Xavier A Madison
(74) *Attorney, Agent, or Firm* — Buchanan Ingersoll & Rooney P.C.

(57) ABSTRACT

A method is disclosed for forming a tissue bundle from a stack of folded absorbent tissues. The method includes the steps of forming a stack of folded absorbent tissues; compressing the stack to an initial density in a first compression step; wrapping the stack a first time in a supporting wrapper to form an initial bundle and maintain the initial density; subsequently applying a second compression step to compress the stack to a final density that is higher than the initial density; and wrapping the stack a second time to form a final bundle and to maintain the final density.

20 Claims, 5 Drawing Sheets

(51) Int. Cl.
*B65B 11/10* (2006.01)
*B65B 13/20* (2006.01)

(58) Field of Classification Search
USPC ..... 53/429
See application file for complete search history.

(56) References Cited

U.S. PATENT DOCUMENTS

| | | | | |
|---|---|---|---|---|
| 4,679,379 | A | 7/1987 | Cassoli | |
| 4,909,388 | A | 3/1990 | Watanabe | |
| 5,195,300 | A | 3/1993 | Kovacs et al. | |
| 5,535,887 | A * | 7/1996 | Young | B65D 83/08 206/494 |
| 5,853,547 | A | 12/1998 | Ahrens et al. | |
| 7,527,709 | B2 | 5/2009 | Lippi et al. | |
| 7,550,061 | B2 | 6/2009 | Walkenhaus et al. | |
| 7,744,726 | B2 | 6/2010 | Scherb et al. | |
| 2003/0066268 | A1 | 4/2003 | George | |
| 2006/0130431 | A1 | 6/2006 | Baggot et al. | |
| 2007/0090009 | A1 * | 4/2007 | Clare | B65D 77/2024 206/440 |
| 2010/0236956 | A1 | 9/2010 | Kling et al. | |
| 2013/0269893 | A1 * | 10/2013 | Nelvig | B65B 63/02 162/111 |
| 2014/0245701 | A1 | 9/2014 | Loevenich | |
| 2016/0368631 | A1 * | 12/2016 | Ikawa | B65D 81/2023 |
| 2018/0160867 | A1 * | 6/2018 | Wallenius | B65B 63/02 |

FOREIGN PATENT DOCUMENTS

| | | | |
|---|---|---|---|
| CN | 102556520 | A | 7/2012 |
| CN | 104129542 | A | 11/2014 |
| CN | 104870347 | A | 8/2015 |
| CN | 106144084 | A | 11/2016 |
| EP | 0220980 | A1 | 5/1987 |
| EP | 1156925 | A1 | 11/2001 |
| FR | 1395509 | A | 4/1965 |
| GB | 2264278 | A | 8/1993 |
| SU | 996277 | A1 | 2/1983 |
| WO | 9316925 | A1 | 9/1993 |
| WO | 9638353 | A1 | 12/1996 |
| WO | 0040405 | A1 | 7/2000 |
| WO | 02096756 | A1 | 12/2002 |
| WO | 2012087211 | A1 | 6/2012 |
| WO | 2014072951 | A1 | 5/2014 |

OTHER PUBLICATIONS

International Search Report (PCT/ISA/210) dated Sep. 7, 2017, by the European Patent Office as the International Searching Authority for International Application No. PCT/EP2016/082013.

Written Opinion (PCT/ISA/237) dated Sep. 7, 2017, by the European Patent Office as the International Searching Authority for International Application No. PCT/EP2016/082012.

Written Opinion of the International Preliminary Examining Authority (PCT/IPEA/408) dated Jan. 17, 2019, by the European Patent Office as the International Searching Authority for International Application No. PCT/EP2016/082012.

International Preliminary Report on Patentability (PCT Article 36 and Rule 70) (Form PCT/IPEA/409) dated May 16, 2019, by the European Patent Office, in corresponding International Application No. PCT/EP2016/082012. (12 pages).

Office Action dated Feb. 12, 2020 by the Federal Service for Intellectual Property in Russian Patent Application No. 2019122844/10(044619) and an English Translation of the Office Action. (9 pages).

Office Action (Communication pursuant to Article 94(3) EPC) dated Jun. 17, 2020, by the European Patent Office in corresponding European Application No. 16 822 982.1-1016 (4 pages).

Office Action (Notification of the First Office Action) dated Mar. 15, 2021 by the China National Intellectual Property Administration (CNIPA) of the People's Republic of China in corresponding Chinese Patent Application No. 201680091498.4, and an English Translation of the Office Action. (9 pages).

* cited by examiner

METHOD OF COMPRESSING TISSUE BUNDLES

TECHNICAL FIELD

The present disclosure relates to a method of handling tissues, in particular, the type of tissues that are provided as a stack of folded individual tissues for use in dispensers. The disclosure relates in particular to methods of compression of such tissues to form compressed tissue bundles and to the resulting bundles.

BACKGROUND ART

Stacks of absorbent tissue paper material are used for providing web material to users for wiping, drying and or cleaning purposes. Conventionally, the stacks of tissue paper material are designed for introduction into a dispenser, which facilitates feeding of the tissue paper material to the end user. Also, the stacks provide a convenient form for transportation of the folded tissue paper material. To this end, the stacks are often provided with a packaging, to maintain and protect the stack during transport and storage thereof.

Accordingly, packages are provided comprising a stack of tissue paper material, and a corresponding packaging. During transportation of packages containing tissue paper material, there is a desire to reduce the bulk of the transported material. Typically, the volume of a package including a stack of tissue paper material includes substantial amounts of air between panels and inside the panels of the tissue paper material. Hence, substantial cost savings could be made if the bulk of the package could be reduced, such that greater amounts of tissue paper material may be transported, e.g., per pallet or truck.

Also, when filling a dispenser for providing tissue paper material to users there is a desire to reduce the bulk of the stack to be introduced into the dispenser, such that a greater amount of tissue paper material may be introduced in a fixed housing volume in a dispenser. If a greater amount of tissue paper material may be introduced into a dispenser, the dispenser will need refilling less frequently. This provides cost saving opportunities in view of a diminished need for attendance of the dispenser.

An example of the type of tissue to which the present disclosure relates is found in WO2012/087211, the content of which is incorporated herein by reference in its entirety. This document explains in detail the desire and advantages relating to increased compression of tissue stacks. It also explains in details the various tissue materials to which it is applicable and the relevant methods of folding and interleaving. Nevertheless, although it teaches that such stacks may be compressed to relatively high densities, it fails to identify certain problems that are associated with compression of the stack beyond the previously accepted values.

One difficulty that may be encountered in performing such a process is the need to introduce a further compression element into an existing production line. Normal production methods for producing such tissue bundles provide for linear transport of logs of stacked tissues through a series of compressing rollers or bands along a compression path. The greater the compression, the longer the compression path must be. For such existing installations, it is not immediately evident that an additional compression step can be added.

A further difficulty lies in the tendency of the upper and lower tissues to become damaged or creased due to the high pressure being applied as the rollers or bands continue to transport the tissue stack or log. In particular, for a log of over 1.5 meters in length, the first part of the log may be evenly compressed, while the rear part of the log may become steadily more distorted. Such creasing is unsightly and can also affect the ease of dispensing in due course. Actual damage to the tissue may build up during a production run and eventually lead to machine failure.

SUMMARY

According to embodiments of the present invention, it has now surprisingly been found that an improved tissue bundle may be achieved by compressing the stack in a two-step process. Accordingly, a method is disclosed of forming a tissue bundle, comprising a stack of folded absorbent tissues, the method comprising: forming a stack of folded absorbent tissues; compressing the stack to an initial density in a first compression step; wrapping the stack a first time in a supporting wrapper to form an initial bundle and maintain the initial density; subsequently applying a second compression step to compress the stack to a final density that is higher than the initial density; and wrapping the stack a second time to form a final bundle and to maintain the final density.

In one embodiment, the stack is wrapped the second time in a final wrapper that is different to the supporting wrapper. This may allow a simple wrapper to be used as the supporting wrapper, while a significantly stronger wrapper may be used to wrap the tight bundle and maintain the final density. It will be understood that the tissue will be subject to a certain amount of spring-back after compression and that this spring-back must be resisted by the wrapper. It should also be noted that reference to the initial density and final density is understood to be the density after spring back against the wrapper has occurred. The stack may thus be compressed to a slightly higher density and on relaxing against the wrapper, will assume a slightly lower density. The compressed density at the termination of the compression step may be 4% to 40% higher than the wrapped density after spring-back, depending upon the arrangement and effectiveness of the wrapping operation. In one embodiment, this over-compression may be around 20-25%.

If the stack is wrapped in a final wrapper, the supporting wrapper may either be removed or left in place. Removal of the supporting wrapper may take place before during or after the second compression step and may be achieved by cutting, tearing or otherwise unwrapping the initial wrapper.

In an alternative embodiment, the stack is wrapped the second time by re-wrapping the supporting wrapper. This may be achieved by nipping, i.e., pleating and folding the supporting wrapper to take up the slack. The supporting wrapper may be adhered to itself by any appropriate means, including adhesive, heat sealing or additional elements such as tape. If the supporting wrapper is used as the final wrapper, it must be strong enough to withstand the spring-back pressure exerted by the stack. To this end, high-tensile paper such as virgin-pulp based paper having a weight of at least 70 gsm, preferably at least 80 gsm and even over 90 gsm and a tensile strength in a direction along the height H of the stack of at least 3.5 kN/m2, preferably at least 4.5 kN/m2, most preferred at least 5.5 kN/m2.

The initial density may be any density that is a suitable starting point for achieving the final density. It will also depend upon the sort of tissue that is being packaged as further defined below. In many cases, it will be the density that is achieved using the existing compression step according to the known art. On the other hand, advantages may be achieved by reducing or increasing the compression of the first step, given that it is the final density that is the primary objective. In certain embodiments, the initial density is more than 0.15 g/cm3 but less than 0.3 g/cm3, depending upon the sort of tissue. More specifically, for structured tissue the, initial density may be less than 0.2 g/cm3, for hybrid tissue the density may be less than 0.25 g/cm3 and for dry crepe, the initial density may be less than 0.3 g/cm3.

The final density will also depend upon the sort of tissue that is being packaged. In one embodiment, the tissues are of structured tissue and the final density is greater than 0.2 g/cm3, optionally greater than 0.25 g/cm3 and even greater than 0.3 g/cm3. In another embodiment, the tissues are of hybrid tissue and the final density is greater than 0.25 g/cm3, optionally greater than 0.3 g/cm3 and even greater than 0.4 g/cm3. In a further embodiment, the tissues are of dry crepe tissue and the final density is greater than 0.3 g/cm3, optionally greater than 0.35 g/cm3 and even greater than 0.45 g/cm. In most cases it will be greater than 0.3 g/cm3, optionally greater than 0.4 g/cm3 and even greater than 0.5 g/cm3.

In one embodiment, the stack is compressed in a height direction during the second compression and the final bundle has a height that is less than 70% of the initial bundle, preferably less than 60% and optionally even less than 50% of the initial loose bundle. These values may be achieved by application of a compression with a pressure of greater than 120 kN/m2, preferably greater than 160 kN/m2 and optionally greater than 225 kN/m2. It will be noted that the pressure values quoted here and below are calculated average values based on the machine construction and the forces encountered at the machine. Actual values encountered within the tissue will be transitory and may vary from these averaged values.

According to one aspect of the invention, the second compression step may take place at a time or location that is distant from the first compression step. For example, the initial bundle may be held together by only the supporting wrapper, and not by a compression apparatus. An advantageous result of the first wrapping step and the supporting wrapper is that the product of the first compression step is a stable item that can be stored and/or transported as desired. From a logistical perspective, this makes the second compression step independent of the remainder of the tissue production process rather than being a potentially limiting link in the production chain.

In many production processes, the initial bundle will be in the form of an elongate log, having a length corresponding to the width of the tissue production line. The method may comprise cutting the log transverse to its elongate dimension to form a plurality of tissue packages. A typical log will have a length of more than 1.5 meters, typically from around 1.8 meters to 2.6 meters and may be cut into from 8 to 12 individual packages although it will be understood that this will depend upon the actual width of tissue required.

In one embodiment, the log is cut into tissue packages subsequent to the second compression step. It will however not be excluded that the log is cut between the first and second compression steps and that the second compression step and final wrapping are for individual packages.

The method may be carried out for any form of tissue. The term "tissue" is herein to be understood as a soft absorbent paper having a basis weight below 65 g/m2, and typically between 10 and 50 g/m2. Its uncompressed density is typically below 0.30 g/cm3, preferably between 0.08 and 0.20 g/cm3. The fibres contained in the tissue are mainly pulp fibres from chemical pulp, mechanical pulp, thermo-mechanical pulp, chemo-mechanical pulp and/or chemo-thermo-mechanical pulp (CTMP). The tissue may also contain other types of fibres enhancing, e.g., strength, absorption or softness of the paper. The absorbent tissue material may include recycled or virgin fibres or a combination thereof.

In accordance with one aspect of the method proposed herein, the absorbent tissue material may be a dry crepe material, a structured tissue material, or a combination of at least a dry crepe material and at least a structured tissue material. A structured tissue material is a three-dimensionally structured tissue paper web. The structured tissue material may be a TAD (Through-Air-Dried) material, a UCTAD (Uncreped-Through-Air-Dried) material, an ATMOS (Advanced-Tissue-Molding-System), an NTT material (New Tissue Technology from Valmet Technologies) or a combination of any of these materials. A combination material is a tissue paper material comprising at least two plies, where one ply is of a first material, and the second ply is of a second material, different from said first material.

Optionally, the tissue paper material may be a hybrid tissue. IN the present disclosure, this is defined as a combination material comprising at least one ply of a structured tissue paper material and at least one ply of a dry crepe material. Preferably, the ply of a structured tissue paper material may be a ply of TAD material or an ATMOS material. In particular, the combination may consist of structured tissue material and dry crepe material, preferably consist of one ply of a structured tissue paper material and one ply of a dry crepe material, for example the combination may consist of one ply of TAD or ATMOS material and one ply of dry crepe material. An example of TAD is known from U.S. Pat. No. 5,5853,547; ATMOS from U.S. Pat. Nos. 7,744,726, 7,550,061 and 7,527,709; and UCTAD from EP 1 156 925.

Optionally, a combination material may include other materials than those mentioned in the above, such as for example a nonwoven material. Alternatively, the tissue paper material may be free from nonwoven material The folded tissues may be provided in any appropriate format as required by the end user. Most typically, the folded tissues will be interleaved, in order to facilitate dispensing. They may be interleaved in a V, M or Z configuration.

As indicated above, the initial bundle may be provided in the form of an elongate log. In that case, the second compression step may take place by transporting the log along a compression path. In this context, a compression path is understood to be a path whereby the log is progressively compressed as it passes along the path. The compression path may be defined by rollers or bands that pinch the log as it moves along the compression path. Wrapping may also take place as the log passes along the path. A characteristic of such paths is that the leading end of the log may be under compression for a longer period of time than the trailing end of the log. For an unwrapped log, this can have the effect of producing distortion in the upper and lower surfaces. If the log is still wrapped in its supporting wrapper, these distortions may be reduced or eliminated.

It will be understood that the log may also be compressed in a batch process, i.e., by compression in a stationary situation in a press. In particular, since the second compression step may be distanced from the first compression step, different logistics may be applied and the continuous speed of the tissue production line need have no influence on the batch-wise second compression step. For example, a first compression step may occur continuously, while a second compression step may occur in batch.

Embodiments of the invention also relate to a tissue bundle comprising a stack of interleaved absorbent tissues, wrapped in a wrapper to form a tight final bundle and compressed in a two-step compression process as described above or hereinafter. The bundle preferably has a final density, which for structured tissues is greater than 0.2 g/cm3, optionally greater than 0.25 g/cm3 and even greater than 0.3 g/cm3. For hybrid tissue the final density may be greater than 0.25 g/cm3, optionally greater than 0.3 g/cm3 and even greater than 0.4 g/cm3. In the case of dry crepe tissue, the final density may be greater than 0.3 g/cm3, optionally greater than 0.35 g/cm3 and even greater than 0.45 g/cm.

The tissue bundle may be distinguished in various ways from existing bundles. Not only is it more highly compressed but it is also more consistently compressed along its length. Furthermore, as a result of the re-wrapping step, the initial supporting wrapper may be nipped to tightly wrap the bundle and to maintain the final density.

Other advantages and distinctions of embodiments of the present invention over existing methods and products will be apparent in the light of the following detailed description.

BRIEF DESCRIPTION OF THE DRAWINGS

The present invention will be discussed in more detail below, with reference to the attached drawings, in which.

DESCRIPTION OF EMBODIMENTS

Figure 1:
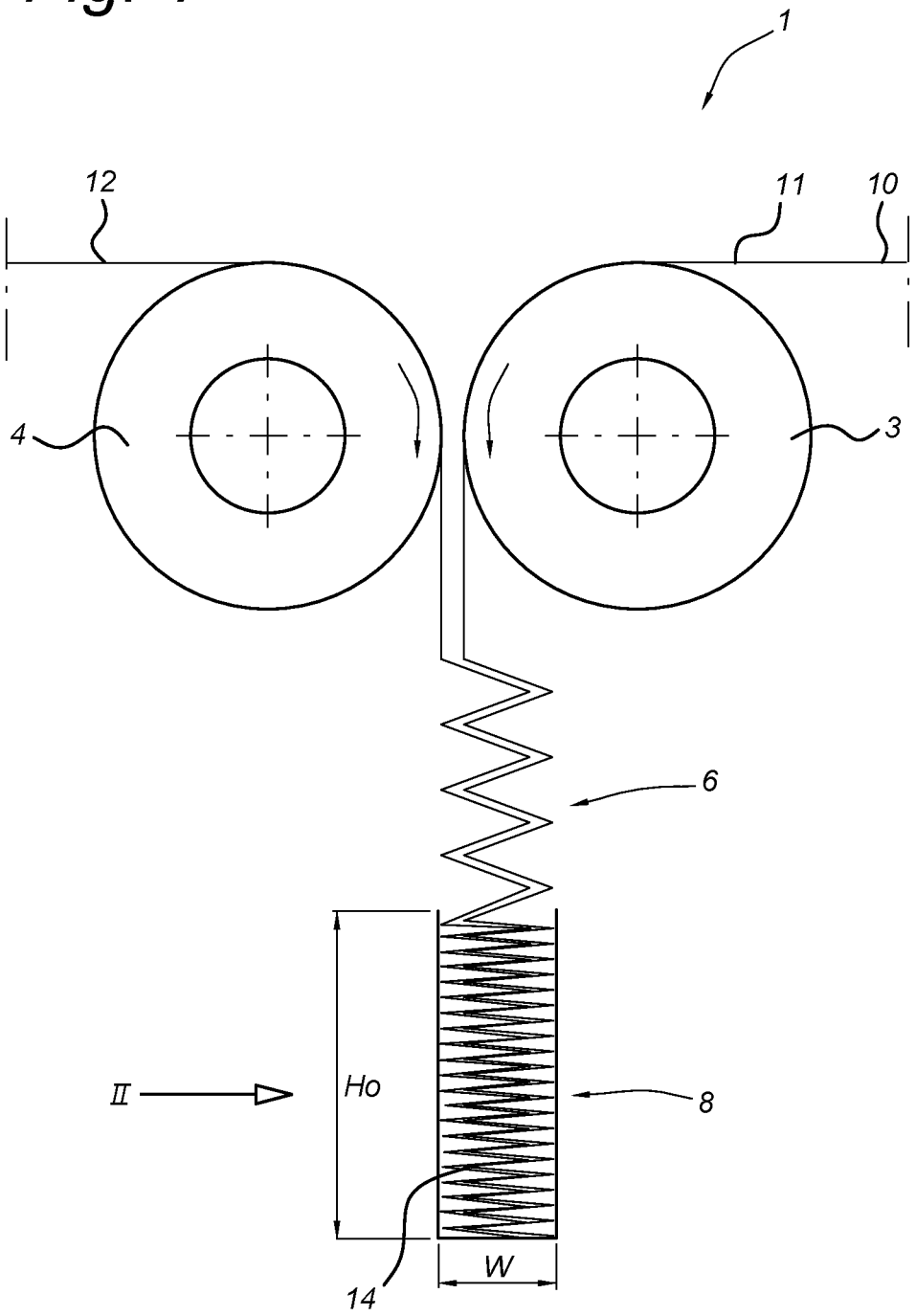
FIG. 1 is a schematic side view of an output part of a conventional tissue production machine.

FIG. 1 is a schematic side view onto an output part of a conventional tissue production machine 1 that may be used according to the present invention. In this embodiment, the machine 1 is for the production of 2-ply dry-crepe tissue 10 according to the SCA article number 140299, each of the plies being 18 gsm. The skilled person will nevertheless understand that any other suitable tissue may also be used.

The machine 1 provides its output as two webs 11, 12 of tissue 10, that are passed around output rollers 3, 4 and cut and folded together at a folding station 6. The tissue 10 coming from the respective webs 11, 12 is folded together in Z-formation, with folds of the respective webs 11, 12 interleaved together as is otherwise well known in the art. The folded tissue 10 is collected as a stack 14 in stacking station 8 until the stack reaches an uncompressed height H0, which in this case is around 130 mm. The stack 14 has a stack width W, which in this case is around 85 mm, being a standardized dimension for use in certain tissue dispensers. These dimensions can of course be adjusted according to the tissue material, the process and/or the required end use.

Figure 2:
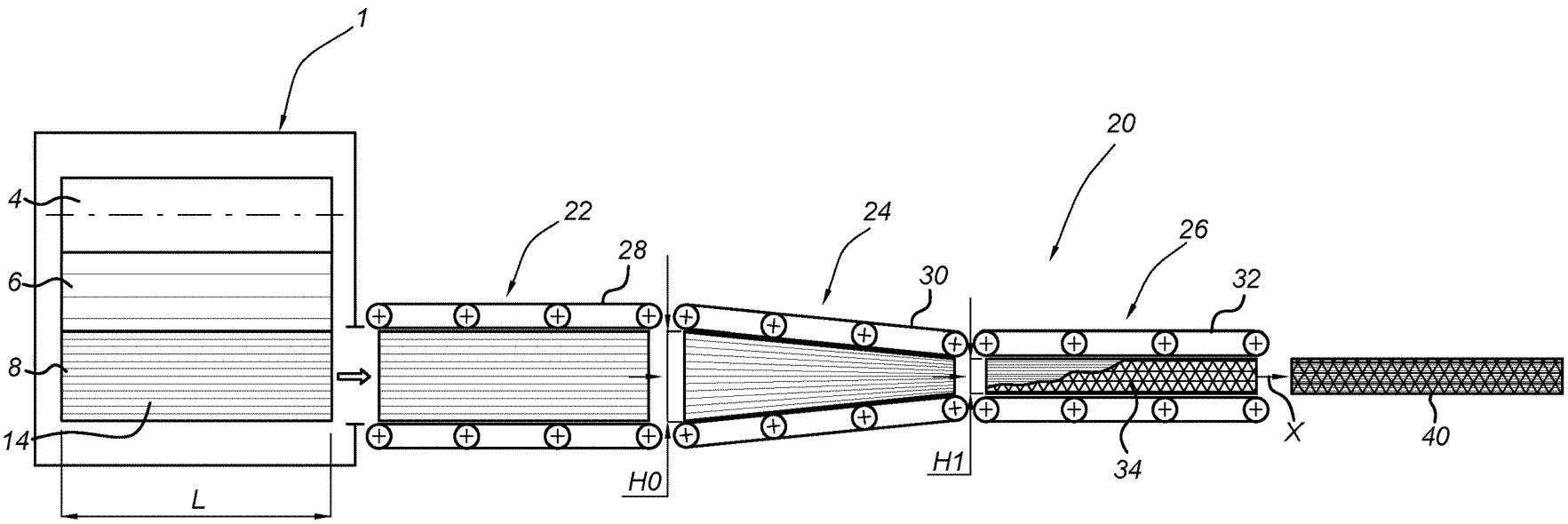
FIG. 2 is a schematic view in the direction II of FIG. 1.

FIG. 2 is a schematic view in the direction II of FIG. 1, in the process direction of the machine 1. It will be understood that the machine 1 is a complex installation having many more components that are neither shown nor discussed as they are otherwise not relevant to the present invention.

According to FIG. 2, the roller 4 is shown above the folding station 6 and the stacking station 8. The tissue webs 11, 12, the rollers 3, 4, the folding station 6 and the stacking station 8 all have an effective width L, which defines the length of the stack 14. In the present embodiment, this length L is 2200 mm although the skilled person will understand that this is a variable that will be determined by the machine and/or the end use.

Aligned with the stack 14, is a compressing and wrapping line 20, comprising a first transport station 22, a first compression station 24 and a first wrapping station 26. The first transport station 22 comprises first transport bands 28, that engage the stack 14 and move it laterally out of the machine 1 in the direction X. This takes place once the stack 14 has reached the uncompressed height H0. Additional rollers, grippers, guides and transport provisions may be present to facilitate this movement. The stack 14 proceeds in the lateral direction X through the first compression station 24, where first compression bands 30 apply compression to the stack 14 to reduce it in height from the uncompressed height H0 to an initial height H1, which in this embodiment is around 120 mm.

In the first wrapping station 26, further transport bands 32 move the stack 14 in the lateral direction X, while a supporting wrapper 34 is applied around the stack 14 to form an initial loose bundle or log 40. The supporting wrapper is in the form of a wrap-around strip, extending over the full length and width of the stack 14, joined to itself along a longitudinal seam by a hotmelt adhesive. It will be understood that a two part wrapper may also be used, employing two seams. The wrapper material is Puro Performance™, available from SCA Hygiene products, with surface weight 60 gsm. In this context, it should be noted that although reference is given to a loose bundle 40, the bundle may be relatively tightly packed due to the first compression step. Nevertheless, at this stage, it is clear to a user that it is a stack of tissues and individual tissues may be immediately identified. As compressed to the initial height H1, the loose bundle 40 has an initial density of around 30 g/cm3. This value is based on a simple L×W×H1 calculation of its volume and will be subject to the normal measurement tolerances. It should also be pointed out that the process and equipment up to this point may be otherwise conventional, with the exception of the wrapping material, which is of virgin 80 gsm paper and significantly stronger than a wrapper conventionally used for a loose bundle of this density.

Figure 3:
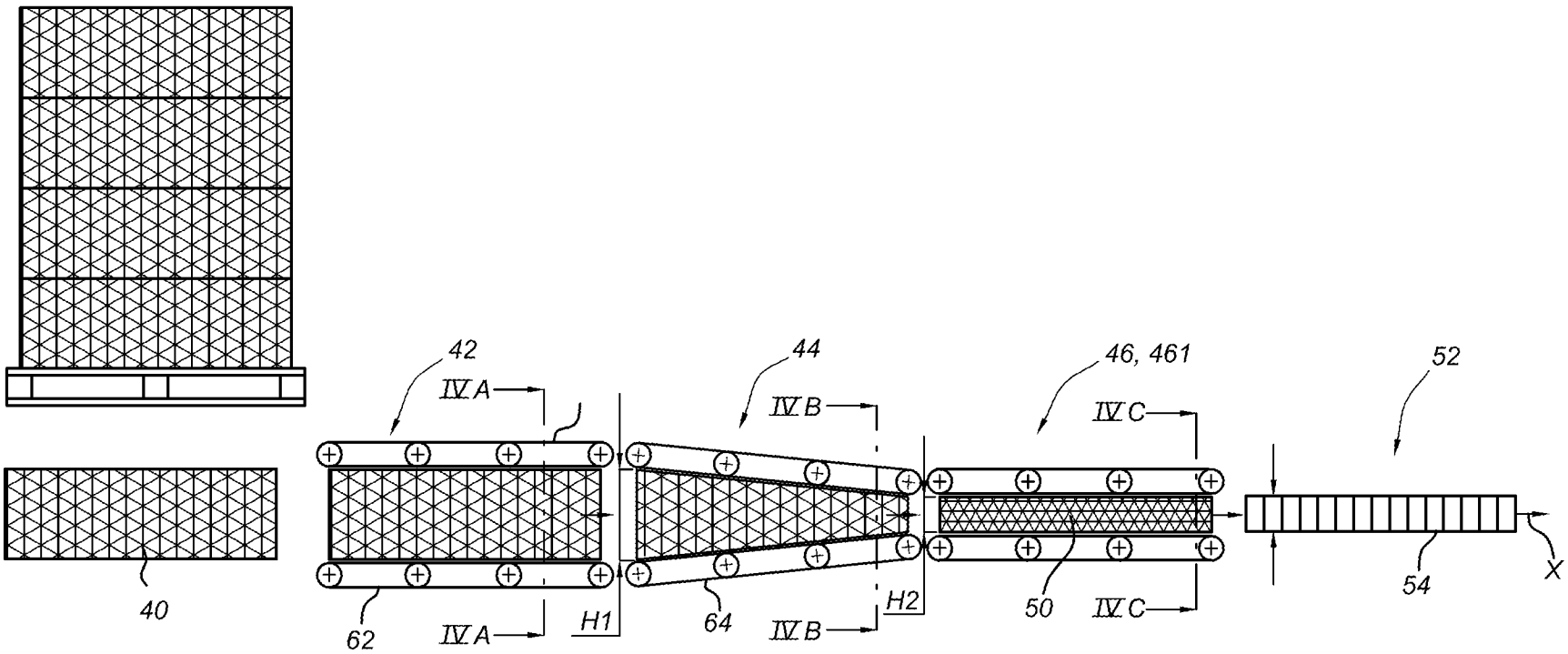
FIG. 3 is a schematic view of operation of a process according to the present disclosure

FIG. 3 shows operation of a process according to the present disclosure, which in this case takes place at a location distant from the machine 1 of FIG. 1. It will however be understood that the process and equipment of FIG. 3 could be implemented directly following the first wrapping station 26 of FIG. 2.

According to FIG. 3, a pallet 48 of loose bundles or logs 40 is provided. These may be provided from storage or as a buffer within a production line. In an initial stage, a loose bundle 40 is loaded onto a second transport station 42, which moves it by means of second transport bands 62, in the lateral direction X towards a second compression station 44. The second compression station 44 comprises second compression bands 64 that operate to pinch the loose bundle 40 as it progresses. The second compression station 44 acts at a considerably higher pressure than the first compression station 24. The pressure of the first compression station may be around 20 kN/m2, while the pressure of the second compression station may be around 160 kN/m2, according to requirements. This compression is sufficient to reduce the height of the stack 14 from the initial height H1 to a final height H2. In the present example, the compression is 2 bar, the final height H2 is around 60 mm and the final density is around 60 g/cm3. At this value, the tissue 10 is still viable and will spring back if not contained. As explained above, due to the presence of the supporting wrapper 34, distortion of the upper- and lowermost tissues 10 within the stack 14 is avoided. A number of factors are believed to further assist in achieving a high quality result. Due to the fact that the compression takes place in two steps, distortion may be reduced. To this end, the amount of compression during the respective first and second compressions may be adjusted. Furthermore, the use of a relatively strong wrapping material may further prevent distortion. In fact, the supporting wrapper may be chosen specifically for the purpose of facilitating the second compression step with the final wrapper being dedicated to withstanding the high compression.

The stack 14 then progresses to a second wrapping station 46, where the stack 14 is rewrapped to form a final tight bundle 50 to maintain the final density and the final height H2, thus preventing it from springing back to the uncompressed state. The second wrapping station 46 may comprise a replacement provision 461 to remove the supporting wrapper 34 and replace it with a high-tensile wrapper. In the following, reference to a tight bundle is intended to refer to the bundle in its final condition. From the second wrapping station 46, the tight bundle advances to a sawing station 52, where it is cut into a number of shorter tissue packages 54. In this case, the tight bundle 50 is cut into 10 tissue packages 54, each having a length of 212 mm.

Figure 4A:
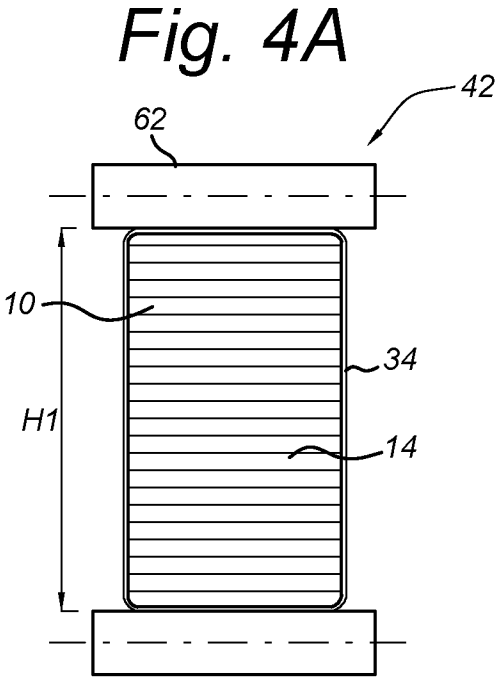
FIGS. 4*a-c* are cross-sectional views through the stations of FIG. 3 in the directions IVa, IVb and IVc respectively.
Figure 4B:
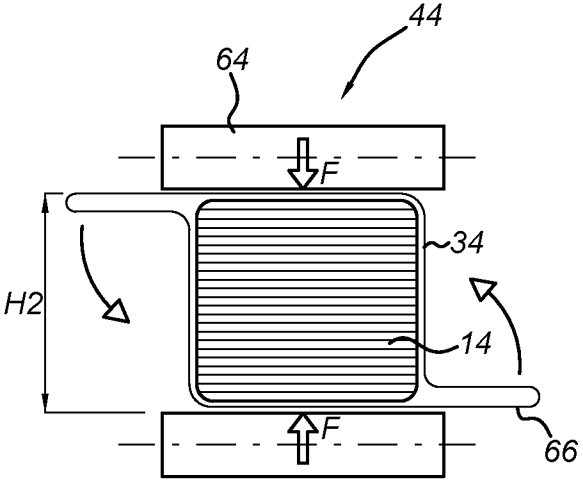
Figure 4C:
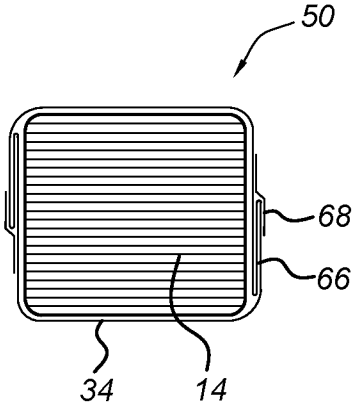

FIGS. 4*a-c* show cross-sectional views through the second transport station 42, second compression station 44 and second wrapping station 46 of FIG. 3 in the directions IVa, IVb and IVc respectively. As can be seen in FIG. 4*a*, the stack 14 in its supporting wrapper 34 is held between the second transport bands 62. At this position, it is still under its initial compression and has its initial height H1. Individual tissues 10 are still visible.

FIG. 4*b* illustrates a cross-section at a position through the second compression station 44 where the stack 14 is fully compressed to its final density. The second compression bands 64 exert a force F on the stack 14 to maintain it at the final height H2. As indicated above, this force F is around 2 bar and the final height H2 is around half of the initial height H1. As a result of this reduction in height, the supporting wrapper 34 develops slack at the sides of the stack 14, which is gathered together as the stack 14 progresses through the compression station by an appropriate guide into a nip 66. It may also be noted here that the compression of the stack 14 is such that individual tissues can no longer be discerned and at this density, the stack is brick-like. In this embodiment, it can be seen that the nip 66 on the right of the stack 14 is gathered at the base of the stack 14 and the nip 66 on the left is gathered at the top of the stack 14.

FIG. 4*c*, is a view through the tight bundle 50 at the exit to the second wrapping station 46. The supporting wrapper 34 has been tightly wrapped around the stack 14 by folding this nips 66 against the stack 14 and adhering them to the supporting wrapper 34 using adhesive tape 68. In this state, the compression of the tight bundle 50 is maintained entirely by the supporting wrapper 34, which must be sufficiently strong to withstand the spring-back force. It will be understood that although the tight bundle 50 is shown with flat upper and lower surfaces, these will inevitably become bowed as the stack 14 relaxes. It will also be noted that the positions of the nips 66 allows them to be folded upwards and downwards respectively, limiting an increase in width of the tight bundle 50.

Figure 5A:
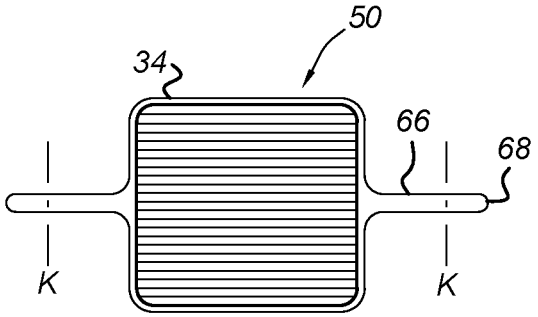
FIGS. 5-7 depict alternative methods of wrapping a final bundle in the stations of FIG. 3.
Figure 5B:
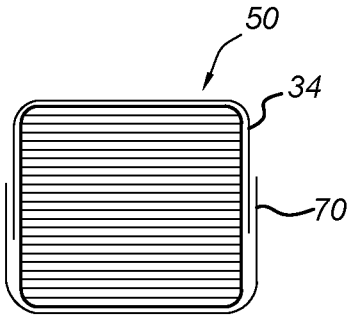

FIG. 5A shows an alternative way in which a tight bundle 50 may be rewrapped. In this embodiment, the nips 66 are formed at the position at which the supporting wrapper 34 has been glued to form the loose bundle. Cuts K are made through the nip 66 to remove the glued portion 68. In FIG. 5B, the supporting wrapper 34 is re-glued by overlapping the ends 70 of the supporting wrapper 34 at the location of the cut.

Figure 6A:
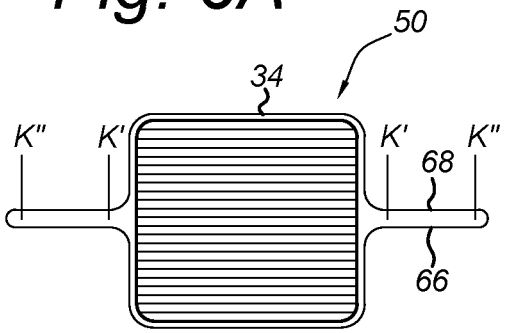
Figure 6B:
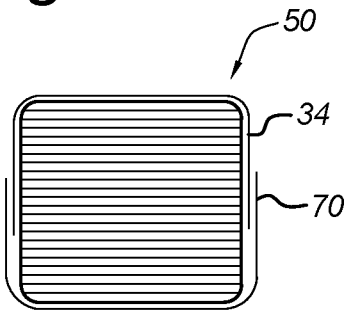

A further alternative method of rewrapping is shown in FIGS. 6A and 6B. In this case, compression of the tight bundle 50 allows nips 66 to be formed in the supporting wrapper 34 as indicated above. In this case, each nip 66 is cut at two separate locations K' and K" to remove the glued portion 68, which is at the upper side of the nip 66. In FIG. 6B, the ends 70 comprising the lower side of the nip 66 are folded upwards and adhered to the remainder of the supporting wrapper 34.

Figure 7A:
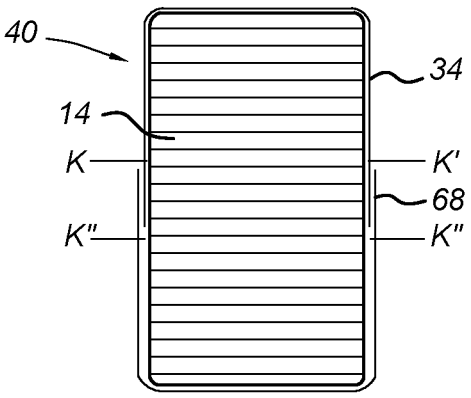
Figure 7B:
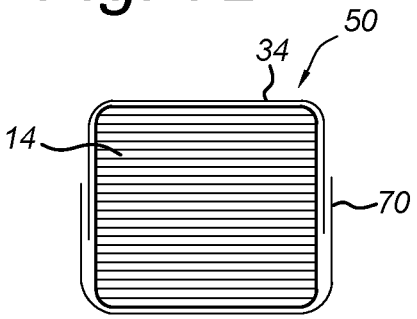

A still further alternative for rewrapping the supporting wrapper 34 is shown in FIGS. 7A and 7B. In this case, cutting takes place of the supporting wrapper 34 while the stack 14 is still a loose bundle 40. Cuts K', K" on either side of the loose bundle 40 remove the glued portion 68. Subsequent compression of the stack 14 as shown in FIG. 7B allows the ends 70 of the supporting wrapper 34 to overlap where they can be again glued together to form the tight bundle 50.

The invention has been described by reference to the embodiments discussed above. It will be recognized that these embodiments are susceptible to various modifications and alternative forms well known to those of skill in the art. In particular, it will be understood that various alternative wrapping processes may be employed for the wrapping or rewrapping of the tight bundle. Additionally, although the process of FIGS. 3 and 4 has been explained as a continuous process using transport bands to transport elongate logs through the respective stations, a similar result may be achieve using a batch process whereby individual logs or packages are compressed and wrapped sequentially.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A method of forming a tissue bundle comprising a stack of folded absorbent tissues, the method comprising:

forming a stack of folded absorbent tissues;

compressing the stack to an initial density in a first compression step;

wrapping the stack a first time in a supporting wrapper to form an initial bundle;

subsequently applying a second compression step to compress the stack to a final density that is higher than the initial density; and re-wrapping the same stack a second time to form a final bundle and to maintain the final density, wherein the tissues are of structured tissue and the final density is greater than 0.2 g/cm$^3$; or the tissues are of hybrid tissue and the final density is greater than 0.25 g/cm$^3$; or the tissues are of dry crepe tissue and the final density is greater than 0.3 g/cm$^3$.

2. The method according to claim 1, wherein the stack is wrapped the second time in a final wrapper that is different to the supporting wrapper.

3. The method according to claim 1, wherein the stack is wrapped the second time by re-wrapping the supporting wrapper.

4. The method according to claim 1, wherein the second compression step is carried out without removing the supporting wrapper.

5. The method according to claim 1, wherein the initial density is less than 0.25 g/cm$^3$.

6. The method according to claim 1, wherein the stack is compressed in a height direction during the second compression and the final bundle has a height that is less than 70% of the initial bundle.

7. The method according to claim 1, wherein the stack is compressed in a height direction during the second compression with a pressure of greater than 120 kN/m2.

8. The method according to claim 1, wherein the second compression step takes place at a time or location that is distant from the first compression step.

9. The method according to claim 1, wherein the initial bundle is in the form of an elongate log and the method comprises cutting the log transverse to its elongate dimension to form a plurality of tissue packages.

10. The method according to claim 9, wherein the log is cut into tissue packages subsequent to the second compression step.

11. The method according to claim 1, wherein the tissues comprise dry crepe material.

12. The method according to claim 1, wherein the tissues are interleaved in a V, M or Z configuration.

13. The method according to claim 1, wherein the initial bundle is in the form of an elongate log and the second compression step takes place by transporting the log along a compression path that is aligned with an elongate direction of the log.

14. The method according to claim 1, wherein a portion of the supporting wrapper is cut away, prior to wrapping the stack a second time to form a final bundle.

15. The method according to claim 14, where the portion cut away is a portion that has been previously adhered on wrapping the stack a first time.

16. A tissue bundle comprising a stack of folded absorbent tissues, wrapped in a wrapper to form a final bundle and compressed in a two-step compression process according to the method of claim 1.

17. The tissue bundle according to claim 16, wherein the wrapper is nipped and folded to tightly wrap the final bundle and to maintain the final density.

18. A packaging machine for forming a tight final tissue bundle from a loose wrapped initial bundle containing a stack of folded absorbent tissues, the packaging machine comprising:

a transport station for conveying an initial bundle having a supporting wrapper to a compression station; and a compression station for compressing the wrapped initial bundle from an initial density to a final tissue bundle having a higher final density and a wrapping station for re-wrapping the same final tissue bundle to maintain the final density, wherein the wrapping station comprises a nip and fold provision to take up excess material in the supporting wrapper and fold it around the final tissue bundle.

19. The packaging machine of claim 18, wherein the packaging machine has a cutter for cutting away at least a portion of the supporting wrapper prior to forming the final tissue bundle.

20. A packaging machine for forming a tight final tissue bundle from a loose wrapped initial bundle containing a stack of folded absorbent tissues, the packaging machine comprising:

a transport station for conveying an initial bundle having a supporting wrapper to a compression station; and a compression station for compressing the wrapped initial bundle from an initial density to a final tissue bundle having a higher final density and a wrapping station for re-wrapping the same final tissue bundle to maintain the final density, wherein the wrapping station comprises replacement provision to remove the supporting wrapper and replace it with a high-tensile wrapper.

* * * * *